US007215071B2

(12) United States Patent
Bucher

(10) Patent No.: US 7,215,071 B2
(45) Date of Patent: May 8, 2007

(54) COLOR CATHODE RAY TUBE HAVING A DETENSIONING MASK FRAME ASSEMBLY

(75) Inventor: Alan Weir Bucher, Manheim, PA (US)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 09/900,369

(22) Filed: Jul. 6, 2001

(65) Prior Publication Data

US 2003/0006686 A1 Jan. 9, 2003

(51) Int. Cl.
*H01J 29/07* (2006.01)

(52) U.S. Cl. ..... 313/407; 313/402

(58) Field of Classification Search ..... 313/402–407, 313/408; 445/47

See application file for complete search history.

(56) References Cited

U.S. PATENT DOCUMENTS

| | | | | |
|---|---|---|---|---|
| 4,866,334 A * | 9/1989 | Fendley et al. | ..... | 313/407 |
| 5,111,107 A | 5/1992 | Kume et al. | ..... | 313/405 |
| 5,932,957 A * | 8/1999 | Ragland, Jr. | ..... | 313/402 |
| 6,046,534 A | 4/2000 | Horiuchi | ..... | 313/402 |
| 6,686,684 B2 * | 2/2004 | Van Der Wilk | ..... | 313/407 |

FOREIGN PATENT DOCUMENTS

| | | | |
|---|---|---|---|
| EP | 0393488 A2 | | 10/1990 |
| EP | 1069592 A2 | | 1/2001 |
| WO | WO 00/11701 | | 3/2000 |
| WO | WO 01/48784 | * | 7/2001 |

* cited by examiner

*Primary Examiner*—Joseph Williams
(74) *Attorney, Agent, or Firm*—Joseph J. Laks; Harvey D. Fried; Patricia Verlangieri

(57) ABSTRACT

A cathode ray tube includes a tension mask attached to a rectangular mask frame assembly that has two long sides paralleling a central major axis thereof and two short sides paralleling a central minor axis thereof. The two long sides are disposed at generally a right angle with respect to the two short sides with each of the sides connected to form a continuous generally planar support frame having an inner and outer peripheral surface. The support frame is formed of a material having a first coefficient of thermal expansion and includes a detensioning member formed of a second coefficient of thermal expansion on the peripheral surface of at least one side of the frame to facilitate detensioning of the mask.

13 Claims, 3 Drawing Sheets

COLOR CATHODE RAY TUBE HAVING A DETENSIONING MASK FRAME ASSEMBLY

FIELD OF THE INVENTION

This invention generally relates to cathode ray tubes (CRTs) and, more particularly, to a tension mask frame assembly for CRTs capable of detensioning.

BACKGROUND OF THE INVENTION

A color cathode ray tube, or CRT, includes an electron gun for forming and directing three electron beams to a screen of the tube. The screen is located on the inner surface of the faceplate panel of the tube and is made up of an array of elements of three different color-emitting phosphors. A shadow mask, which may be either a formed mask or a tension mask having strands, is located between the electron gun and the screen. The electron beams emitted from the electron gun pass through apertures in the shadow mask and strike the screen causing the phosphors to emit light so that an image is displayed on the viewing surface of the faceplate panel.

One type of CRT has a tension mask comprising a set of strands that are tensioned onto a mask support frame to reduce their propensity to vibrate at large amplitudes under external excitation. Such vibrations would cause gross electron beam misregister on the screen and would result in objectionable image anomalies to the viewer of the CRT.

The mask stress required to achieve acceptable vibration performance is below the yield point of the mask material at tube operating temperature. However, at elevated tube processing temperatures, the mask's material properties change and the elastic limit of the mask material is significantly reduced. In such a condition, the mask stress exceeds the elastic limit of the mask material and the material is inelastically stretched. When the tube is cooled after processing, the strands are longer than before processing and the mask frame is incapable of tensing the mask strands to the same level of tension as before processing. Another common problem with tension mask frame assemblies occurs when the mask strand material has a lower coefficient of thermal expansion than the mask support frame material. In such a case, tension on the mask strand increases during thermal processing causing more inelastic strain.

It is desirable to develop a mask frame assembly that allows tension masks to be effectively detensioned during the thermal cycle used to manufacture a CRT to mitigate stretching of the mask.

SUMMARY OF THE INVENTION

The present invention relates to color cathode ray tubes having tension masks, and particularly to a CRT having a tension mask frame assembly comprising a mask support frame constructed of a material having a first coefficient of thermal expansion. The mask support frame includes a detensioning member formed from a second coefficient of thermal expansion material and attached along the periphery of the support frame to facilitate detensioning of the mask.

BRIEF DESCRIPTION OF THE DRAWINGS

The invention will now be described by way of example with reference to the accompanying figures of which.

DETAILED DESCRIPTION OF THE INVENTION

Figure 1:
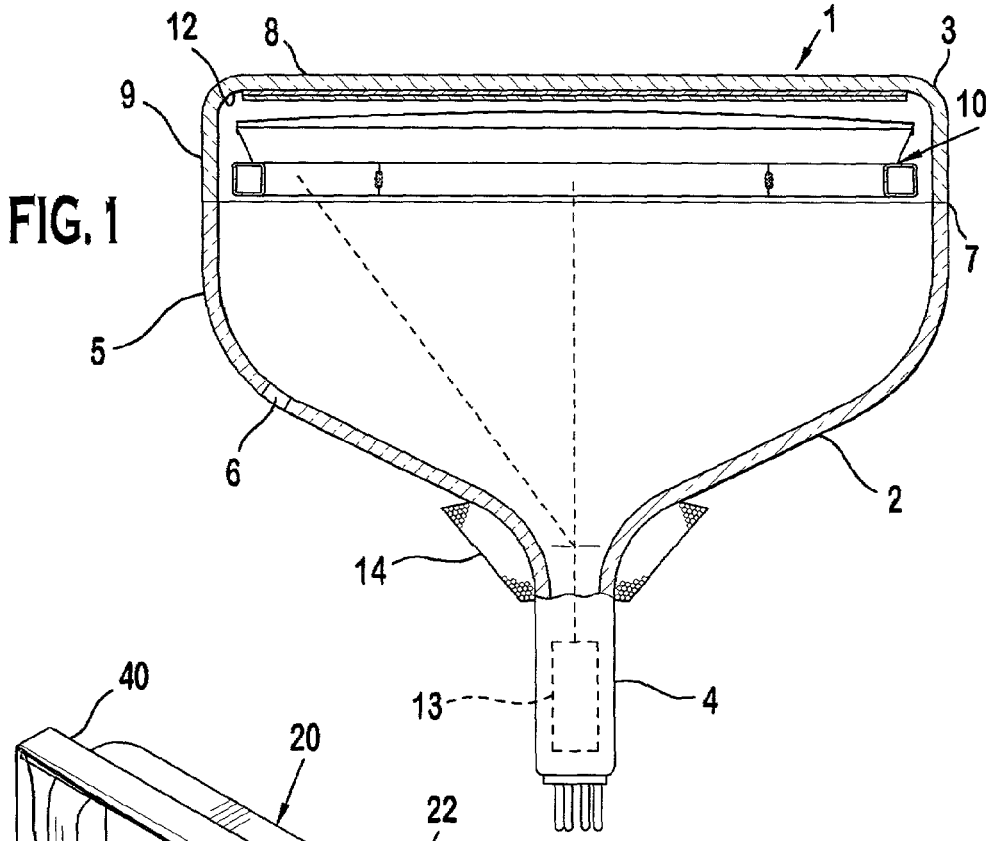
FIG. 1 is a cross sectional view of a CRT showing a tension mask frame assembly.

FIG. 1 shows a cathode ray tube (CRT) 1 having a glass envelope 2 comprising a rectangular faceplate panel 3 and a tubular neck 4 connected by a funnel 5. The funnel 5 has an internal conductive coating (not shown) that extends from an anode button 6 toward the faceplate panel 3 and to the neck 4. The faceplate panel 3 comprises a viewing faceplate 8 and a peripheral flange or sidewall 9, which is sealed to the funnel 5 by a glass frit 7. A three-color phosphor screen 12 is carried by the inner surface of the faceplate panel 3. The screen 12 is a line screen with the phosphor lines arranged in triads, each of the triads including a phosphor line of each of the three colors. A tension mask frame assembly 10 is removably mounted in predetermined spaced relation to the screen 12. An electron gun 13, shown schematically by dashed lines in FIG. 1, is centrally mounted within the neck 4 to generate and direct three inline electron beams, a center beam and two side or outer beams, along convergent paths through the tension mask frame assembly 10 to the screen 12.

The CRT 1 is designed to be used with an external magnetic deflection yoke 14 shown in the neighborhood of the funnel-to-neck junction. When activated, the yoke 14 subjects the three beams to magnetic fields which cause the beams to scan horizontally and vertically in a rectangular raster over the screen 12.

Figure 2:
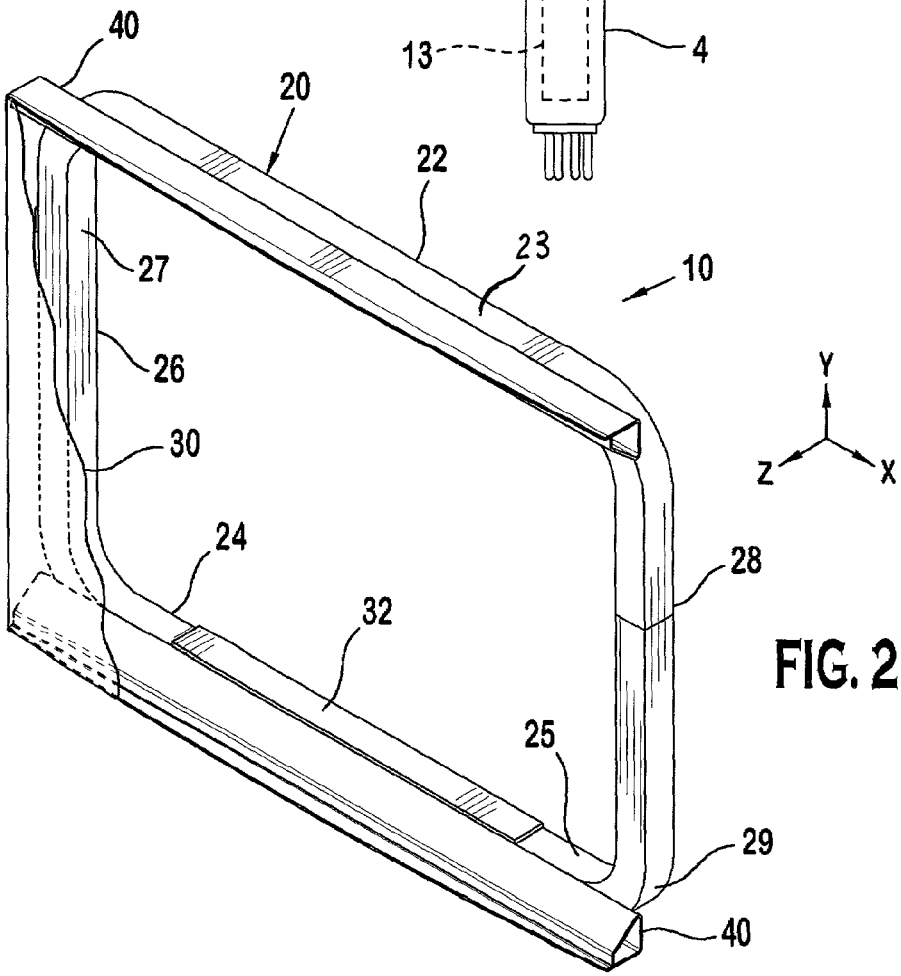
FIG. 2 is a perspective view of the tension mask frame assembly.

The tension mask frame assembly 10, as shown in FIG. 2, includes two long sides 22 and 24, and two short sides 26 and 28. The two long sides 22, 24 of the tension mask frame assembly 10 are parallel to a central major axis, X, of the tube; and the two short sides 26, 28 parallel a central minor axis, Y, of the tube. The two long sides 22, 24 and two short sides 26, 28 form a continuous planar mask support frame 20 along those major and minor axes. The frame 20 comprises elongated wall portions 23, 25 and 27, 29 extending along the peripheral edge of the inside and outer surfaces of the long sides 22, 24 and short sides 26, 28 respectively.

The frame assembly 10 includes an apertured tension shadow mask 30 (shown here diagrammatically as a sheet for simplicity) that contains a plurality of metal strips (not shown) having a multiplicity of elongated slits (not shown) therebetween that parallel the minor axis, Y, of the tube. The mask 30 is fixed to a pair of support blade members 40 which are fastened to the frame 20 at mounting locations 33 (as shown best in FIGS. 3–7). The support blade members 40 may vary in height from the center of each support blade member 40 longitudinally to the ends of the support blade member 40 to permit the best curvature and tension compliance over the tension shadow mask 30.

Figure 3:
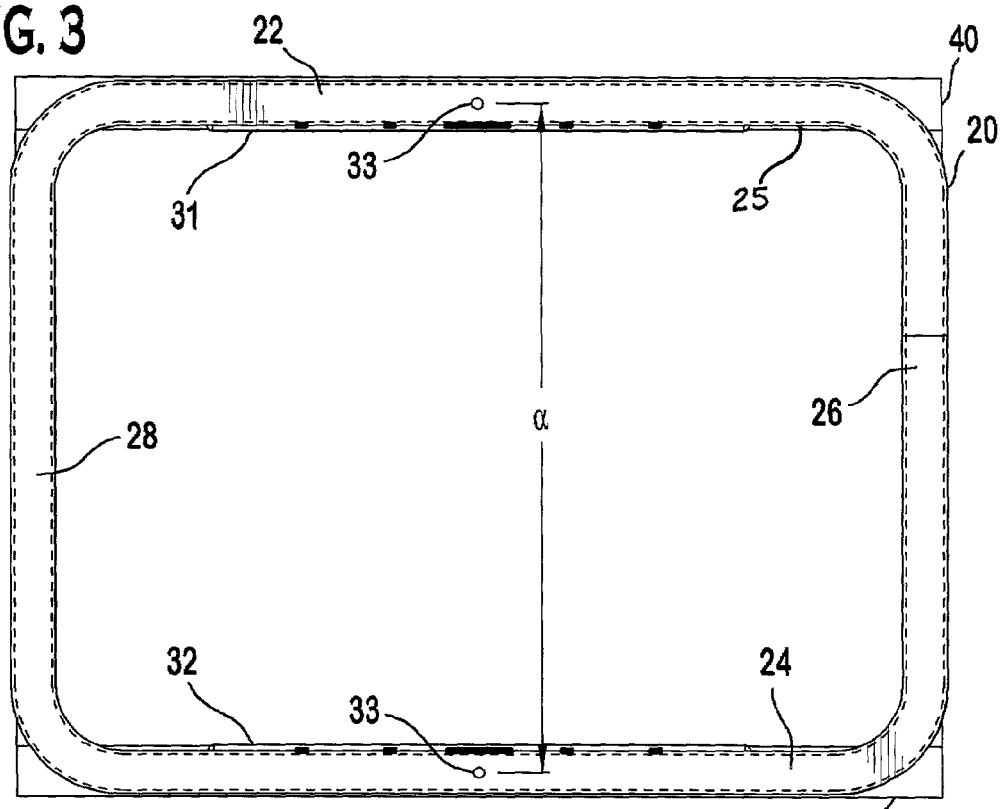
FIG. 3 is a rear view of the tension mask frame assembly.
Figure 4:
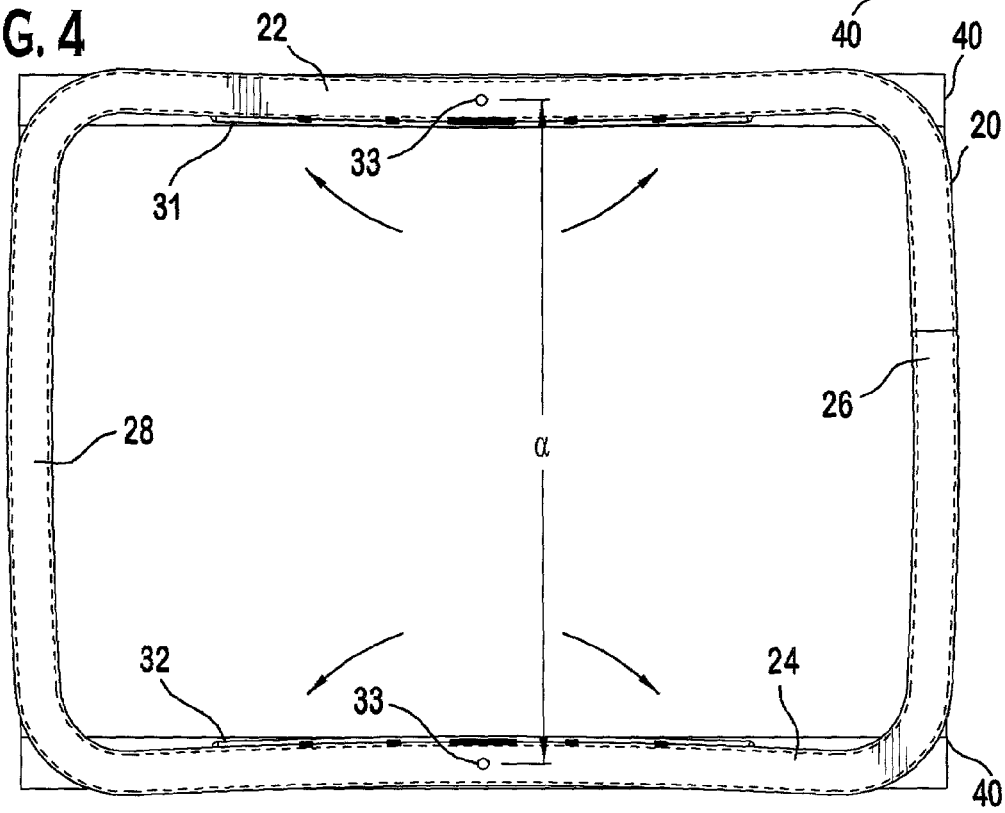
FIG. 4 is a rear view of the tension mask frame assembly shown at an elevated temperature.

As shown in FIGS. 3 and 4, a pair of the detensioning members 31, 32 are fixed to the inner peripheral surfaces of the two long sides 22, 24 along wall portions 25. Each of the detensioning members 31, 32 are formed of a material which has a higher coefficient of thermal expansion than the frame 20. The distance a shows a distance between the mounting locations 33 where the support blade members 40 are attached to the frame 20. It should be understood that FIG. 3 shows the frame 20 and support blade members 40 at room temperature. FIG. 4 shows the frame 20 and support blade members 40 at an elevated temperature whereby the distance a between the mounting locations 33 is relatively smaller. The frame 20 is configured such that upon expansion due to elevated temperatures, the long sides 22, 24 are caused to bow inward toward the center of the frame 20 along the X–Y plane by the detensioning members 31, 32. This effect occurs because the detensioning members 31, 32 have a relatively high coefficient of thermal expansion and expand faster than the long sides 22, 24 of frame 20 during heating. The inward bowing of the two long side 22, 24 has a detensioning effect on the mask 30 because the distance between the mounting locations 33 become smaller at increased temperatures thereby drawing the support blade members 40 toward each other reducing tension in the mask 30. It should be understood that the detensioning members 31, 32 are preferably fastened to the long sides 22, 24 by welding but other suitable techniques may be utilized.

Figure 5:
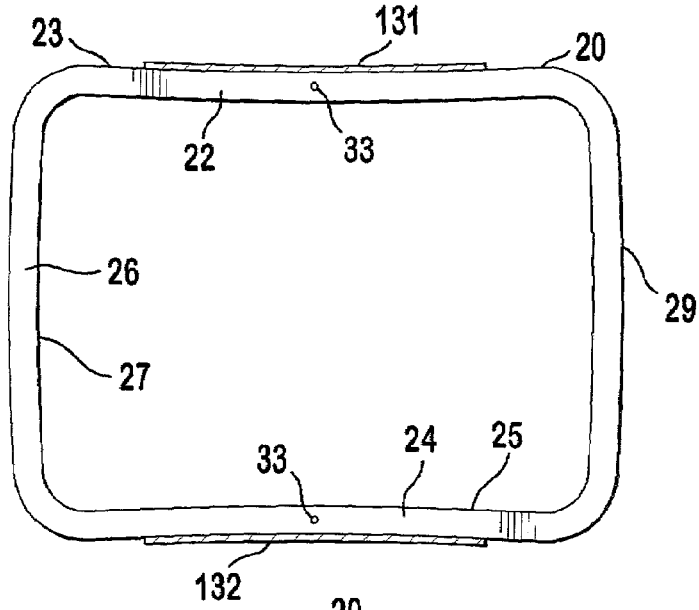
FIG. 5 is a front diagrammatic view showing an alternate placement for the detensioning members.

FIG. 5 shows a first alternate embodiment in which detensioning members 131, 132 are fixed to outer peripheral surfaces of the long sides 22, 24 along wall portions 23. Here, the detensioning members 131, 132 have a relatively lower coefficient of thermal expansion than the frame 20. The detensioning members 131, 132 therefore expand at a lesser rate than the long sides 22, 24 during heating similarly forcing the mounting locations 33 toward each other to detension the mask 30 attached to the support blade members 40 during heating.

Figure 6:
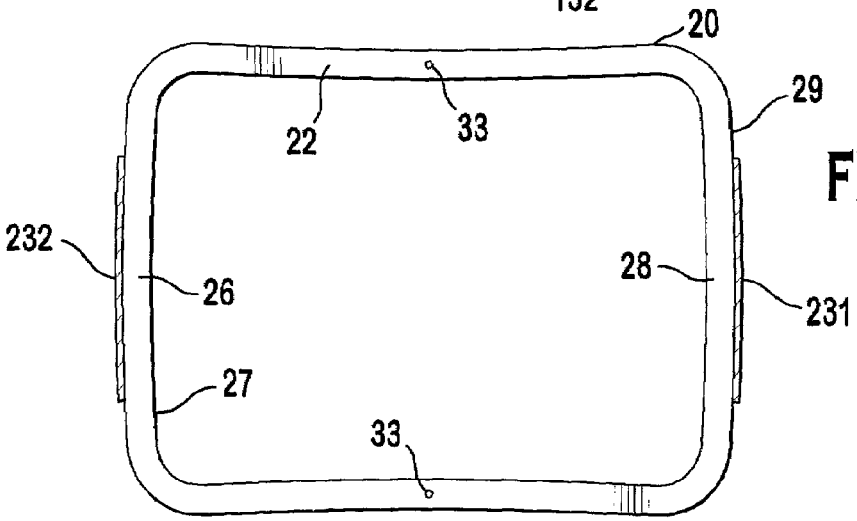
FIG. 6 is a front diagrammatic view showing another alternate placement for the detensioning members.

Yet another alternate embodiment is shown in FIG. 6 in which detensioning members 231, 232 are fixed to outer peripheral surfaces of the short sides 26, 28 along wall portions 29. Here, the detensioning members 231, 232 each have a coefficient of thermal expansion which is relatively higher than that of the short sides 26, 28 of frame 20. The detensioning members 231, 232 therefore expand at a greater rate than the short sides 26, 28 forcing them to bow outward and causing the long sides 22, 24 to bow inward so as to urge the mounting locations 33 toward each other thereby drawing the support blade members 40 toward each other and detensioning the mask 30 during heating. It should be understood that the detensioning members 231, 232 may alternatively be fixed to the inner peripheral surface of the short sides 26, 28 along wall portions 27 to detension the mask 30 provided the coefficient of thermal expansion of the detensioning members 231, 232 material is relatively lower than the frame 20 as described above with reference to FIGS. 4–5.

Figure 7:
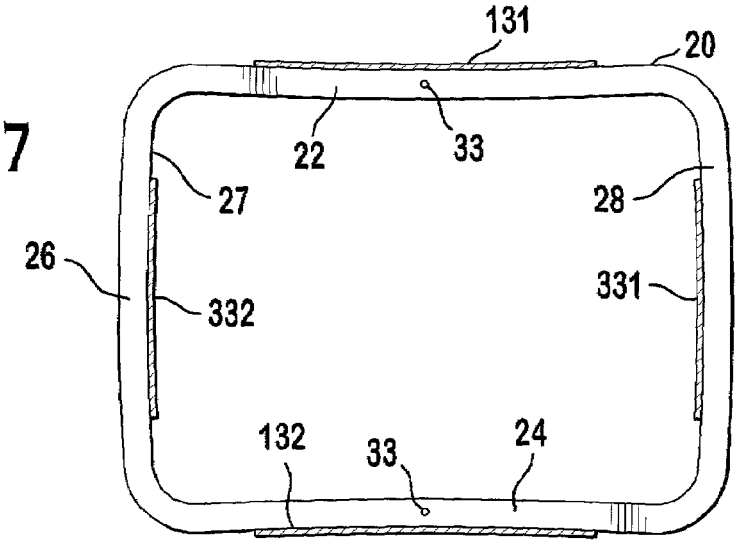
FIG. 7 is a front diagrammatic view showing yet another alternate placement for the detensioning members.

FIG. 7 shows yet another alternate embodiment in which each side of the frame 20 includes a detensioning member. In this embodiment, detensioning members 331, 332 are applied to the inner peripheral surface of the short sides 26, 28 along wall portions 27. Also, detensioning members 131,132 are applied to the outer surfaces of the long sides 22, 24 as was described with reference to FIG. 5. Detensioning members 131, 132 and 331, 332 all have a relatively low coefficient of thermal expansion than the corresponding sides of the frame 20 to which they are attached. It should be understood that detensioning members 131, 132 may be fixed along the inside surface of long sides 22, 24 and detensioning members 331, 332 may be fixed along the outside surface of short sides 26, 28 with detensioning members having a relatively high coefficient of thermal expansion than the sides to which they are attached.

It should be understood that the placement of the detensioning members along the peripheral surfaces of the frame 20 discussed above are exemplary and that other arrangements may be used. In some embodiments the detensioning members may be positioned solely along the wall portions on the outer peripheral surfaces or the inner peripheral surfaces formed by the long sides 26, 28 and short sides 22, 24 of the frame 20. Alternatively, one or more wall portions of the frame 20 may include a detensioning member having a coefficient of thermal expansion adapted to cause the distance of the mounting locations 33 to shorten as discussed above thereby drawing the mask support blades 40 toward each other to facilitate detensioning of the mask 30.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A tension mask frame assembly for a CRT comprising:

a substantially rectangular mask support frame having a first coefficient of thermal expansion and including a central major axis and a central minor axis perpendicular to each other, said frame having a pair of opposing long sides extending in parallel to the major axis and a pair of opposing short sides extending in parallel to the minor axis each sides having an outer peripheral surface and an inner peripheral surface;

a tension mask supported between a pair of support blade members, the support blade members each being attached to said frame at an attachment point along a respective one of the pair of opposing long sides; and a detensioning member fixed along one of the outer and inner peripheral surfaces of one of the pair of opposing long sides and the pair of opposing short sides and having a second coefficient of thermal expansion whereby said attachment points are drawn toward each other during thermal cycling of said mask frame assembly.

2. A tension mask support frame assembly of claim 1 wherein said second coefficient of thermal expansion is lower than said first coefficient of thermal expansion.

3. A tension mask support frame assembly of claim 1 wherein said second coefficient of thermal expansion is higher than said first coefficient of thermal expansion.

4. In a cathode ray tube having a tension mask and frame assembly comprising:

a mask mounted in tension on a substantially rectangular frame, said frame having a first coefficient of thermal expansion and including a pair of opposing long sides and short sides disposed at generally a right angle with respect to the long sides with each of said sides connected to form a continuous generally planar frame having an inner and outer peripheral surface; and detensioning members fixed along the peripheral surfaces of said sides and having a second coefficient of thermal expansion wherein said second coefficient of thermal expansion of said detensioning members is one of greater than said first coefficient of thermal expansion and lower than said first coefficient of thermal expansion.

5. The cathode ray tube of claim 4 wherein said frame includes a pair of support blade members, each of the support blade members having at least one generally central attachment point for attaching each of said support blade members to a pair of said opposing sides of said frame.

6. A tension mask support frame assembly of claim 1 wherein said opposing long and short sides lie in a frame plane.

7. The tension mask support frame assembly of claim 6 wherein the peripheral surface along which the detensioning member is fixed lies generally orthogonal to the frame plane.

8. The tension mask frame assembly of claim 7 wherein said frame includes a pair of support blade members, each support blade member having at least one generally central attachment point for attaching each of said support blade members to a pair of said opposing sides of said frame.

9. A cathode ray tube comprising:

a glass envelope having a rectangular faceplate panel and a tubular neck extending from the rectangular faceplate through a funnel;

an electron gun centrally mounted within the tubular neck for generating and directing electron beams toward the phosphor screen; and, a tension mask frame assembly mounted between the electron gun and the faceplate panel; the tension mask frame assembly having a substantially rectangular mask support frame formed of a pair of opposing long sides extending parallel to a major axis and a pair of opposing short sides connected between the long sides and extending parallel to a minor axis to form a planar rectangular mask support frame, a tension mask supported on said frame between a pair of mounting locations, each being located on one of said opposing sides and, a detensioning member being fixed along a peripheral surface of at least one of said sides, said detensioning member having a coefficient of thermal expansion which is different from the coefficient of thermal expansion of the frame whereby said mounting locations are drawn toward each other during thermal cycling of said mask frame assembly.

10. The cathode ray tube of claim 9 further comprising a pair of support blade members being mounted to said tension mask frame assembly at said mounting locations.

11. The cathode ray tube of claim 10 wherein said tension mask is fixed to said support blade members.

12. The cathode ray tube of claim 9 wherein the opposing long and short sides lie in a common plane.

13. The cathode ray tube of claim 12 wherein said detensioning member is fixed along a peripheral surface of one of said short sides which is generally orthogonal to the common plane.

* * * * *